United States Patent [19]

Timuska

[11] Patent Number: 5,011,389

[45] Date of Patent: Apr. 30, 1991

[54] ROTOR FOR A ROTARY SCREW MACHINE

[75] Inventor: Karlis Timuska, Spånga, Sweden

[73] Assignee: Svenska Rotor Maskiner AB, Stockholm, Sweden

[21] Appl. No.: 320,773

[22] Filed: Mar. 8, 1989

Related U.S. Application Data

[63] Continuation-in-part of Ser. No. 314,119, Feb. 1, 1989, abandoned.

[30] Foreign Application Priority Data

Sep. 5, 1986 [SE] Sweden ..... 8603720
Sep. 4, 1987 [WO] PCT Int'l Appl. ... PCT/SE87/00397

[51] Int. Cl.[5] ..... F04C 29/00; F04C 18/16
[52] U.S. Cl. ..... 418/152; 418/178
[58] Field of Search ..... 418/1, 152, 153, 178, 418/179, 201 R

[56] References Cited

U.S. PATENT DOCUMENTS

| | | | |
|---|---|---|---|
| 2,868,442 | 1/1959 | Nilsson | 418/152 |
| 3,535,057 | 10/1970 | Kodra | 418/1 |
| 4,086,043 | 4/1978 | Howe | 418/152 |
| 4,464,101 | 8/1984 | Shibuya | 418/125 |
| 4,568,255 | 2/1986 | Lavender et al. | 417/477 |
| 4,717,322 | 1/1988 | Masuda et al. | 418/152 |
| 4,764,098 | 8/1988 | Iwase et al. | 418/152 |
| 4,768,888 | 9/1988 | McNaull | 417/423.3 |

FOREIGN PATENT DOCUMENTS

| | | | |
|---|---|---|---|
| 2409554 | 9/1975 | Fed. Rep. of Germany | 418/152 |

OTHER PUBLICATIONS

The Polymer Handbook (3rd Edition), J. Brandrup, E. H. Immergut, Wiley-Interscience Publication, 1989, p. V36.

*Primary Examiner*—Leonard E. Smith
*Attorney, Agent, or Firm*—Frishauf, Holtz, Goodman & Woodward

[57] ABSTRACT

A rotor for a rotary screw machine having helical lobes and intermediate grooves, the rotor having a core including a shaft 1 of a first material and a rotor body 2 of a second material mounted on the shaft. The surface of the rotor is coated with a plastic layer 3.

23 Claims, 1 Drawing Sheet

ROTOR FOR A ROTARY SCREW MACHINE

BACKGROUND OF THE INVENTION

This Patent Application is a continuation-in-part of U.S. Pat. application No. 07/314,119, filed Feb. 1, 1989, now abandoned.

The present invention relates to a rotor for a rotary screw machine having helical lobes and intermediate grooves forming the working surface of the rotor, the rotor being axially limited by two radial end surfaces and having a core with a coating on at least said working surface, said coating being at least one layer of substantially uniform thickness and being made of plastic.

Screw rotors are normally manufactured by machine cutting of solid metal blanks. Having a complicated geometry, the screw rotors require high manufacturing precision, and the amount of material to be cut away is very large. In combination these drawbacks result in long manufacturing times and high costs.

Consequent)y, it has long been desired to produce screw rotors in a simpler fashion and With less stringent requirements on precision and accuracy, in order to enable the rotors to be manufactured in very large quantities at reasonable costs.

Endeavours have been made as early as in 1953 to therefore produce the rotors from plastic, as evident from U.S. Pat. No. 2,868,442. This document thus discloses a male rotor for a rotary screw compressor of the Lysholm type, in which the rotor is made of a plastic surrounding a metal core. The core consists onlY of the rotor shaft and the rotor holds a large quantity of plastic. To make a rotor with a large plastic body having varying thickness entails drawbacks of different kinds. Large and varying shrinking results in bad accuracy to size. Such a rotor therefore is appropriate only for small rotor dimensions.

In order to achieve improved strength in a rotor consisting of a plastic surrounding a metal core it is further known to reinforce the plastic with metal. U.S. Pat. No. 3,918,838 discloses a female rotor molded from plastic around a metal shaft whereby the plastic is reinforced by a skeleton having radial metal discs substantially corresponding to the external shape of the rotor. Since the plastic also in this case reaches the rotor shaft the difficulties with varying shrinking remain, in partiCular if such a construction would be used for the male rotor having a larger amount of material.

Attempts also have been made to make a rotor of a metal core substantially corresponding to the external shape of the rotor and coat the rotor with a thin plastic layer. An example of this type is disclosed in GB 1,306,352. The metal core in this case is made integral with the shaft. With regard to the material required for the rotor shaft the manufacture of the rotor body implies a moulding procedure, whereby considerable unevennesses will occur on the external surface thereof. This complicates the moulding of the plastic layer around the metal core since the unevennesses creates constrictions in the narrow space between the rotor body and the surrounding mould which obstruct a uniform distribution of the plastic in said space. The unevennesses also create unbalanced centrifugal forces in the rotor, in particular at high rpm. These problems could be avoided by milling or grinding the working surface of the rotor body before applying the plastic layer although the manufacturing costs thereby would be increased.

In spite of the achievements in this field—to eliminate the need for machine cutting of the rotors by making them partly of plastic—a satisfactory solution has up to now not been attained, neither through the above mentioned examples nor through other similar constructions.

The object of the present invention thus is to attain a rotor for a rotary screw machine which does not require any machine cutting for creating correct intermeshing lobes and grooves and which does not have the drawbacks entailing earlier attempts to attain this.

SUMMARY OF THE INVENTION

This has according to one aspect of the invention been achieved in that the core of a rotor of the introductionally specified kind includes a shaft of a first material and a rotor body of a second material mounted on said shaft, 1.0 to 3.0 times as great as that of said second material, and the coefficient of thermal expansion of said second material is 1.0 to 6.0 times as great as that of said first material.

The invention also relates to an appropriate application of the rotor in a rotary screw machine.

The invention is further explained in the following detailed description of preferred embodiments of the invention and with reference to the accompanying drawings.

DETAILED DESCRIPTION

Figure 1:
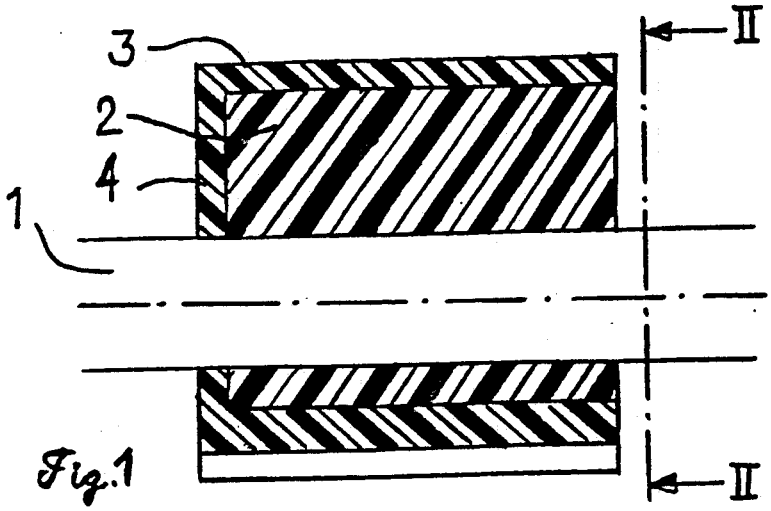
FIG. 1 is a longitudinal sectional view through the upper half of a rotor according to a first embodiment of the invention.
Figure 2:
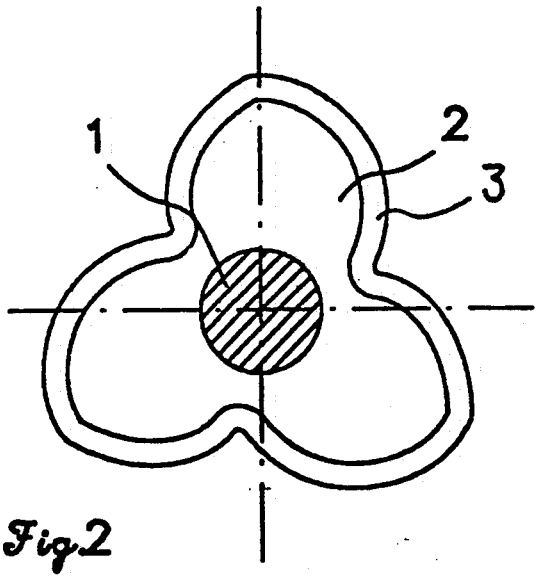
FIG. 2 is an end view of the rotor as seen from line II—II of FIG. 1.

The rotor illustrated in FIGS. 1 and 2 is the male rotor of a rotary screw compressor. It has three helically extending lobes and intermediate grooves to gearingly mesh with grooves and lobes of a female rotor in the compressor.

The rotor consists of a steel shaft 1, on which a rotor body 2 made of ULTEM FXU 230 (Registered Trade Mark of General Electric), which is a porous polyetherimide reinforced with 30% by weight glass fibers, is mounted.

Due to the abrasive character of glass fibers a low fiber content on the surface of the outer coating is required.

The lobes and grooves of the rotor are coated with a layer 3 of ULTEM 2100 (Registered Trade Mark of General Electric), which is a polyetherimide reinforced with 10% by weight glass fibers and not being porous. The thickness of the layer is about 4 millimeters on a rotor of 70 mm diameter and the length of the fibers lies in the range from some tenths of millimeters to some ten millimeters.

With the selected combination of materials the rotor body 2 has a coefficient of thermal expansion, $\alpha = 20 \times 10^{-6}$ m/m/°K.

$\alpha$ for the shaft 1 is $12 \times 10^{-6}$ and $\alpha$ for the coating 3 is $32 \times 10^{-6}$. As a consequence thereof an advantageous distribution of thermal stresses occuring during operation of the compressor will be attained.

The different layers of the rotor are secured to each other by shrinkage fittings. All plastics have a certain shrinkage in moulding. This in mould shrinkage increases with increasing fiber content. When overmoulding the metal part 1 the radial shrinkage gives a good fit of the plastic in the rotor body 2 to the steel shaft 1. The coating 3 having a lower fiber content gives a good fit to the rotor body 2.

Moulding of the low fiber content coating directly onto the steel shaft would give high shrinkage stress and the coating may possibly crack.

Also one end face of the rotor is coated with a layer 4 of the same material as in the layer 3 securing an even end surface at the end of the rotor facing the high pressure end wall of the compressor.

Figure 3:
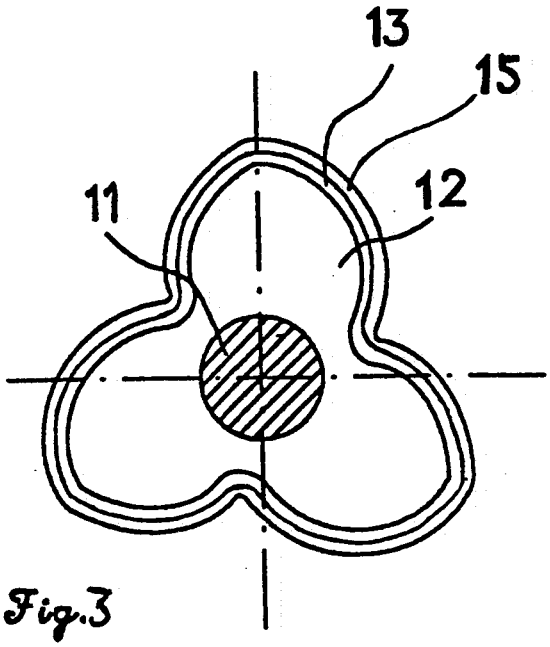
FIG. 3 is a view similar to that of FIG. 2 but showing a second embodiment of the invention.

FIG. 3 shows a second embodiment of the rotor. The core consists of a steel shaft 11 and a rotor body 12 made of Aluminium. The coating consists of tWo layers 13 and 15. The inner layer 13 is made of ULTEM 2100. The outer layer 15 is made of ULTEM 1000 (Registered Trade Mark of General Electric), which is a polyetherimide containing no fibers. $\alpha$ for the parts 11, 12, 13 and 15 are $12\times10^{-6}$, $24\times10^{-6}$, $32\times10^{-6}$ and $52\times10^{-6}$, respectively.

A core consisting of two or more layers of material gives good accuracy of the outer plastic layer in the coating, and machining of the rotor profile is not required.

Thus, by the present invention, a rotor has been attained which is of a construction that eliminates the need for machine cutting of the rotor profile and which also meets required demands on shape accuracy and strength. The low density of the material a)so will reduce unbalanced centrifugal forces.

What is claimed is:

1. In a rotor for a rotary screw machine having helical lobes and intermediate grooves forming the working surface of the rotor, the rotor being axially limited by two radial end surfaces and having a core with a coating on at least said working surface, said coating comprising at least one layer of substantially uniform thickness and being made of plastic, the improvement wherein:

said core includes a shaft of a first material and a rotor body of a second material mounted on said shaft, and the coefficient of thermal expansion of said plastic is 1 to 3 times as great as that of said second material, and the coefficient of thermal expansion of said second material is 1 to 6 times as great as that of said first material.

2. A rotor according to claim 1 in which said second material is a plastics material.

3. A rotor according to claim 2 in which said second material is a polyetherimide.

4. A rotor according to claim 2 in which said plastics material is reinforced with fibers.

5. A rotor according to claim 2 in which said second material is a polyetherimide which is reinforced with fibers.

6. A rotor according to claim 5 in which said fibers are glass fibers and the amount of said fibers corresponds to 10 to 40% by weight of said second material.

7. A rotor according to any one of claims 2 to 6 in which said second material is porous.

8. A rotor according to claim 1 in which said second material is a metal.

9. A rotor according to any one of claims 1 to 6 or 8 in which said plastic coating consists of one layer polyetherimide.

10. A rotor according to claim 9 in which said polyetherimide contains 0 to 40% by weight of reinforcing fibers.

11. A rotor according to any of claims 1 to 6 or 8 in which said coating also is applied on at least one of said end surfaces of said rotor.

12. A rotor according to claim 11 in which said coating also is applied on at least one of said end surfaces of said rotor.

13. In a rotary screw machine having a housing provided with a rotor therein, the rotor having helical lobes and intermediate grooves forming the working surface of the rotor, the rotor being axially limited by two radial end surfaces and having a core with a coating on at least said working surface, said coating comprising at least one layer of substantially uniform thickness and being made of plastic, the improvement wherein:

said core includes a shaft of a first material and a rotor body of a second material mounted on said shaft, and the coefficient of thermal expansion of said plastic is 1 to 3 times as great as that of said second material, and the coefficient of thermal expansion of said second material is 1 to 6 times as great as that of said first material.

14. In a rotor for a rotary screw machine having helical lobes and intermediate grooves forming the working surface of the rotor, the rotor being axially limited by two radial end surfaces and having a core with a coating on at least said working surface, said coating being of substantially uniform thickness and being made of plastic, the improvement wherein:

said core includes a shaft of a first material and a rotor body of a second material mounted on said shaft, said plastics coating consists of two layers, the coefficient of thermal expansion of said plastic is 1 to 3 times as great as that of said second material, and the coefficient of thermal expansion of said second material is 1 to 6 times as great as that of said first material.

15. A rotor according to claim 14, in which said second material is metal.

16. A rotor according to claim 14, in which said second material is a plastics material.

17. A rotor according to claim 16, in which said second material is a polyetherimide.

18. A rotor according to claim 16, in which said plastics material is reinformed with fibers.

19. A rotor according to claim 16, in which said second material is a polyetherimide which is reinforced with fibers.

20. A rotor according to claim 19 in which said fibers are glass fibers and the amount of said fibers corresponds to 10 to 40% by weight of said second material.

21. A rotor according to any one of claims 14 to 15 in which each of said coating layers is made of polyetherimide containing 0 to 40% by weight of reinforcing fibers.

22. In a rotary screw machine having a housing provided with a rotor therein, the rotor having helical lobes and intermediate grooves forming the working surface of the rotor, the rotor being axially limited by two radial end surfaces and having a core with a coating on at least said working surface, said coating being of substantially uniform thickness and being made of plastic, the improvement wherein:

said core includes a shaft of a first material and a rotor body of a second material mounted on said shaft, said plastics coating consists of two layers, the coefficient of thermal expansion of said plastic is 1 to 3 times as great as that of said second material, and the coefficient of thermal expansion of said second material is 1 to 6 times as great as that of said first material.

23. A rotary screw machine according to claim 22, in which each of said coating layers is made of polyetherimide containing 0 to 40% by weight of reinforcing fibers.

* * * * *

UNITED STATES PATENT AND TRADEMARK OFFICE

CERTIFICATE OF CORRECTION

PATENT NO. : 5,011,389

DATED : April 30, 1991

INVENTOR(S) : Karlis TIMUSKA

It is certified that error appears in the above-identified patent and that said Letters Patent is hereby corrected as shown below:

In the title page, Section [56] References Cited, insert the following:

Under "U.S. PATENT DOCUMENTS" -

| | | |
|---|---|---|
| 2,519,588 | 8/1950 | McCulloch |
| 3,841,805 | 10/1974 | Zalis |
| 3,918,838 | 11/1975 | Moody, Jr. et al |

Under "FOREIGN PATENT DOCUMENTS" -

| | | |
|---|---|---|
| 1 944 942 | 3/1970 | Fed. Rep. of Germany |
| 1 306 352 | 2/1973 | Great Britain |
| 1 433 132 | 4/1976 | Great Britain |
| DE 34 24148A1 | 1/1986 | Fed. Rep. of Germany |

Under "OTHER DOCUMENTS" -

Japanese Patent Abstracts of Japan, Vol.7, No. 287 (M-264), Japanese Patent Publication No.58-160585, Katsumi Matsubara.

Signed and Sealed this

Twenty-ninth Day of June, 1993

*Attest:*

*Attesting Officer*

Michael K. Kirk

MICHAEL K. KIRK

*Acting Commissioner of Patents and Trademarks*